US007100578B2

(12) United States Patent
Yamazaki et al.

(10) Patent No.: US 7,100,578 B2
(45) Date of Patent: Sep. 5, 2006

(54) METHOD FOR DRIVING FUEL INJECTION PUMP

(75) Inventors: Shigeru Yamazaki, Odawara (JP); Shogo Hashimoto, Odawara (JP)

(73) Assignee: Mikuni Corporation, Tokyo (JP)

( * ) Notice: Subject to any disclaimer, the term of this patent is extended or adjusted under 35 U.S.C. 154(b) by 190 days.

(21) Appl. No.: 10/497,004

(22) PCT Filed: Nov. 1, 2002

(86) PCT No.: PCT/JP02/11424

§ 371 (c)(1),
(2), (4) Date: Oct. 6, 2004

(87) PCT Pub. No.: WO03/046363

PCT Pub. Date: Jun. 5, 2003

(65) Prior Publication Data

US 2005/0053470 A1 Mar. 10, 2005

(30) Foreign Application Priority Data

Nov. 29, 2001 (JP) ..... 2001-363706

(51) Int. Cl.
*F02M 37/04* (2006.01)

(52) U.S. Cl. ..... 123/499; 361/154

(58) Field of Classification Search ..... 123/497, 123/498, 499, 478, 446; 361/154
See application file for complete search history.

(56) References Cited

U.S. PATENT DOCUMENTS 4,327,695 A * 5/1982 Schechter ..... 123/504
6,024,071 A * 2/2000 Heimberg et al. ..... 123/490
6,283,095 B1 * 9/2001 Krueger ..... 123/499
6,964,263 B1 * 11/2005 Xi et al. ..... 123/499

FOREIGN PATENT DOCUMENTS

| | | |
|---|---|---|
| JP | 2-81947 | 3/1990 |
| JP | 3-264766 | 11/1991 |
| JP | 4-19353 | 1/1992 |
| JP | 2001-221137 | 8/2001 |
| WO | 02/12708 | 2/2002 |

* cited by examiner

*Primary Examiner*—Thomas Moulis
(74) *Attorney, Agent, or Firm*—Wenderoth, Lind & Ponack, L.L.P.

(57) ABSTRACT

The present invention achieves an increase in the amount of vapor that is expelled, stabilized fuel injection and improved starting characteristics in a fuel injection pump. In an electromagnetically driven fuel injection pump 20 which allows fuel to escape into the return passage 5 in the initial region of the pressure-feeding stroke of the plunger 21, and which pressure-feeds fuel into the injection port 33 in the later region of the pressure-feeding stroke, pulse powering of the coil 23 that does not lead to the injection of fuel, i.e., pulse powering which is such that the plunger 21 performs a reciprocating motion through the initial region, is performed when the engine 2 is in an idle operating state, or in a state in which the engine 2 is re-started after being stopped immediately following high-load operation. As a result, vapor can be expelled with good efficiency, and the flow rate of the circulated fuel is increased so that the cooling effect is also increased, thus causing the generation of vapor to be suppressed as well, so that the starting characteristics or re-starting characteristics are improved.

20 Claims, 5 Drawing Sheets

METHOD FOR DRIVING FUEL INJECTION PUMP

BACKGROUND OF THE INVENTION

1. Field of the Invention

The present invention relates to a method for driving a fuel injection pump which is used to supply fuel to an internal combustion engine (hereafter referred to simply as an "engine"), and more particularly relates to a method for driving a fuel injection pump used in engines that are mounted on two-wheeled vehicles or the like.

2. Description of the Related Art

For example, as is described in Japanese Patent Application Laid-Open No. 2001-221137, a fuel injection pump in which fuel conducted from a fuel tank by means of a feed pipe is pressure-fed by means of an electromagnetically driven plunger pump, fuel in the initial region of the pressure-feeding stroke is circulated back to the fuel tank by means of a return pipe, and fuel in the later region of the pressure-feeding stroke is injected into the intake passage from an injection nozzle, is known as a fuel injection pump used in engines mounted on two-wheeled vehicles or the like.

In this apparatus, a discharge mechanism is provided which circulates fuel containing vapor (air bubbles) back to the fuel tank via the return pipe in advance, before the fuel that has been pressure-fed by the plunger pump is injected by the injection nozzle.

In the abovementioned apparatus, there may be cases in which large quantities of vapor are generated in the supplied fuel when the ambient temperature is high, or as a result of heat generated by the coil during electromagnetic driving or the like; accordingly, it is necessary to remove this generated vapor with good efficiency.

For example, the temperature is high immediately after the engine has been stopped or the like; as a result, there is a danger that large quantities of vapor will be generated. Accordingly, in cases where the engine is re-started from this high-temperature state, it is difficult to re-start the engine (good re-starting characteristics are not obtained); furthermore, a certain amount of time is required in order to discharge the generated vapor by means of the discharge mechanism, so that stable fuel injection cannot be obtained.

Furthermore, in cases where the engine is placed in an idle operating state following high-load operation, the amount of fuel circulation (recycling) is small while the environment is a high-temperature environment; as a result, the vapor that is generated cannot be reliably discharged.

SUMMARY OF THE INVENTION

The present invention was devised in light of the abovementioned points; it is an object of the present invention to provide a fuel injection pump driving method which promotes the expulsion of generated vapor while suppressing a rise in temperature during idle operation or the like, without making any particular structural alterations, and which securely expels vapor generated by a high-temperature atmosphere, so that the starting characteristics in the case of re-starting or the like are improved.

The fuel injection pump driving method of the present invention is a driving method for a fuel injection pump which comprises a plunger which draws in and pressure-feeds fuel by means of a reciprocating motion, allowing the fuel to escape into the return passage in the initial region of the pressure-feeding stroke, and pressure-feeding the fuel into the injection port in the later region of the pressure-feeding stroke, a magnetic excitation coil which exerts an electromagnetic exciting force on the plunger, and means for controlling the powering of the coil so as to cause injection of fuel in accordance with the operating conditions of the engine, wherein the control means perform pulse powering of the coil that does not lead to the injection of fuel, when the engine is in a specified state.

If this construction is used, driving is performed so that there is no injection of fuel, i.e., so that the plunger performs a reciprocating motion within the range of the initial region of the pressure-feeding stroke, when the engine is in a specified state (e.g., an operating state, high-temperature stopped state or the like in which vapor tends to be generated in the fuel); accordingly, the generated vapor can be positively discharged into the return passage.

As a result, vapor can be efficiently expelled, and the flow rate of the circulated fuel can also be increased so that the cooling effect is also increased, thus suppressing the generation of vapor.

In the abovementioned construction, a construction may be employed in which the control means perform pulse powering of the coil that does not lead to the injection of fuel during intervals between pulse powering that causes the injection of fuel when the engine is in an idle operating state.

If this construction is used, pulse powering that does not inject fuel (non-injection driving pulses) is added during intervals between pulse powering (injection driving pulses) that causes fuel injection when the engine is in an idle operating state; accordingly, even under conditions in which the fuel flow rate is small, the vapor that is generated can be efficiently expelled, and a cooling effect is obtained so that the generation of vapor can be suppressed.

Furthermore, in the abovementioned construction, a construction may be employed in which the control means perform pulse powering of the coil that does not lead to fuel injection when the power supply that is used to start the engine is placed in an "on" state prior to starting.

If this construction is used, then the plunger is driven in the range of the initial region of the pressure-feeding stroke prior to the starting or re-starting of the engine; accordingly, accumulated vapor can be expelled beforehand so that the engine starting characteristics, and especially the re-starting characteristics, are improved.

In the abovementioned construction, a construction may be employed in which the control means perform pulse powering of the coil that does not lead to the injection of fuel for a specified period of time or a specified number of times after said power supply has been placed in an "on" state.

If this construction is used, then pulse powering is performed for a preset period of time or number of times; accordingly, useless driving after the vapor has been completely expelled can be avoided, so that the power consumption can be reduced.

In the abovementioned construction, a construction may be employed in which the control means set a pulse width for the coil that does not lead to the injection of fuel, on the basis of at least one of the state quantities consisting of the current of the coil, the voltage of the power supply and the frequency of pulse powering that causes the injection of fuel.

If this construction is used, then high-precision powering control can be accomplished by controlling the pulse width on the basis of the abovementioned state quantities that relate to the operation of the engine.

In the abovementioned construction, a construction may be employed in which the control means set a pulse width for the coil that does not lead to the injection of fuel, on the basis of temperature information.

If this construction is used, then higher-precision powering control in accordance with the operating state of the engine can be accomplished by setting a pulse width that does not lead to the injection of fuel on the basis of the fuel temperature or temperature information such as the engine temperature, oil temperature, coil temperature or the like, which is related to the fuel temperature.

In the abovementioned construction, a construction may be employed in which the control means determine on the basis of temperature information whether or not to perform pulse powering that does not lead to the injection of fuel.

If this construction is used, then useless driving can be avoided by using the fuel temperature or temperature information such as the outside air temperature, engine temperature, oil temperature, coil temperature or the like (which are related to the fuel temperature) to determine whether or not to perform pulse powering that does not lead to the injection of fuel, and not powering the coil in (for example) extremely low-temperature environments in which vapor tends not to be generated; accordingly, the power consumption can be reduced.

BRIEF DESCRIPTION OF THE DRAWINGS

FIG. 3 is a timing chart which illustrates the pulse powering of the fuel injection pump in a state in which the power supply of the engine has been switched on;

DESCRIPTION OF THE PREFERRED EMBODIMENTS

Embodiments of the present invention will be described below with reference to the attached figures.

Figure 1:
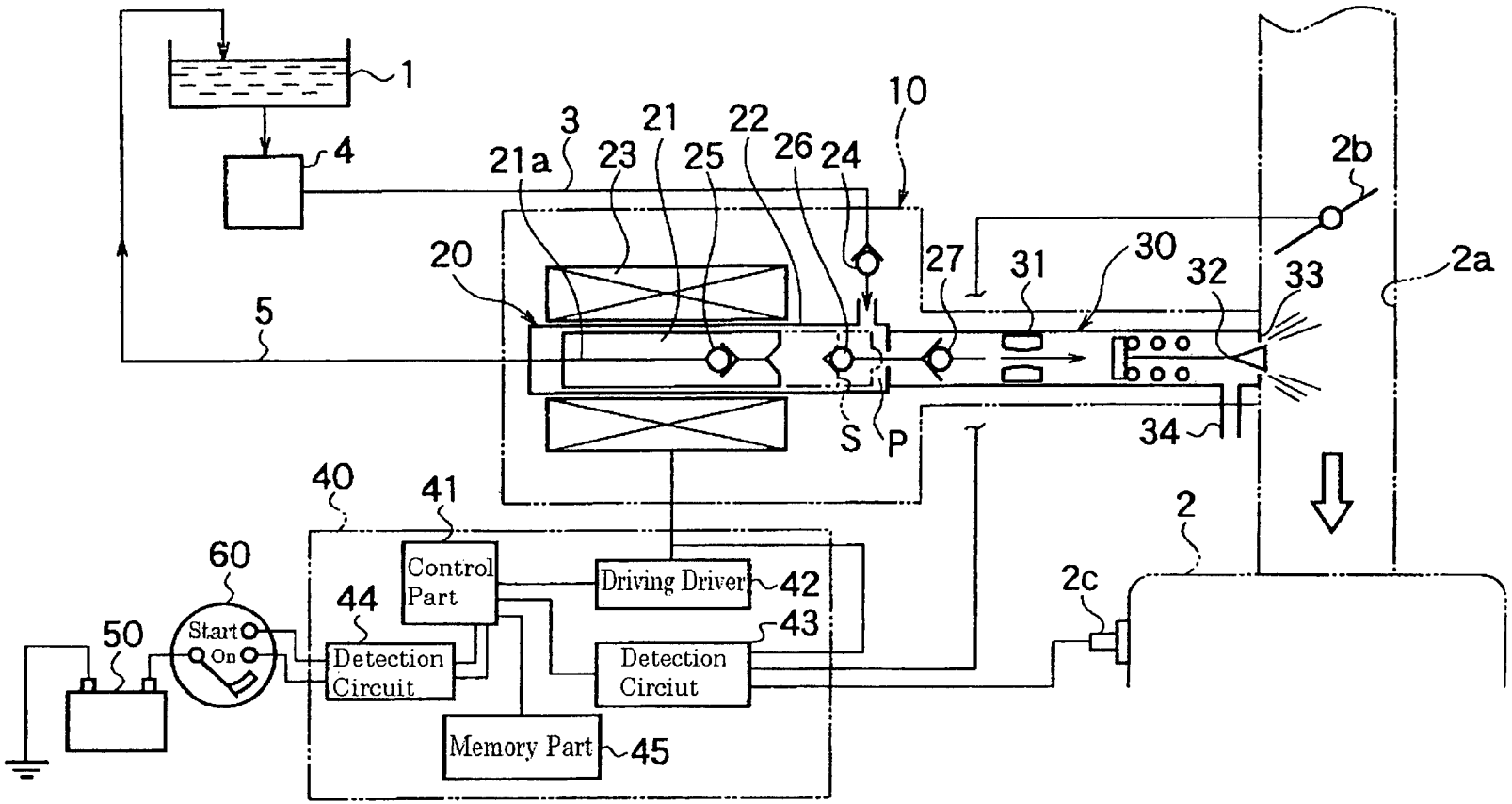
FIG. 1 is a schematic structural diagram which shows a fuel supply system employing a fuel injection pump using the driving method of the present invention.

FIG. 1 is a schematic structural diagram which shows a fuel supply system of an engine mounted on a two-wheeled vehicle. As is shown in FIG. 1, this fuel supply system comprises a fuel tank 1 for the two-wheeled vehicle, a fuel injection device 10 which is disposed in the intake passage 2*a* of the engine 2, and which consists of an electromagnetically driven fuel injection pump 20 and an injection nozzle 30, a feed pipe 3 which supplies fuel, a low-pressure filter 4 which is disposed at an intermediate point in the feed pipe 3, a return pipe 5 which forms a return passage that returns a portion of the supplied fuel (excess fuel) to the fuel tank 1, an engine control unit (ECU) 40 used as control means for controlling the driving of the fuel injection pump 20, a battery 50 used as a power supply, a key switch 60 which performs on/off switching of the power supply for the system as a whole, as well as starting of the engine 2, and the like.

As is shown in FIG. 1, the fuel injection pump 20 comprises a plunger 21 which performs a reciprocating motion, a cylinder 22 which accommodates the plunger 21 so that the plunger 21 is free to slide, an excitation coil 23 which is used to generate lines of magnetic force in a yoke (not shown in the figures) disposed on the outside of the cylinder 22, a check valve 24 which allows only flow toward a pressure-feeding chamber P demarcated on the tip end of the cylinder 22, a check valve 25 which is disposed in a plunger passage 21*a* formed inside the plunger 21, and which allows only flow from the pressure-feeding chamber P toward the return pipe (return passage) 5, a spill valve 26 which closes the plunger passage 21*a* at the end of the initial region of the pressure-feeding stroke, a check valve 27 which allows discharge when the fuel inside the pressure-feeding chamber P has been pressurized to a specified pressure or greater, and the like. Furthermore, when the coil 23 is not powered, the plunger 21 is driven by a return spring (not shown in the figures and positioned in a waiting position (the positioned indicated by a solid line in FIG. 1).

As is shown in FIG. 1, the injection nozzle 30 comprises an orifice nozzle 31 which has an orifice that is constricted to a specified opening diameter, a poppet valve 32 which opens when the fuel passing through the orifice nozzle 31 reaches a specified pressure or greater, an injection port 33 which injects fuel, an assist air pipe 34 which supplied air for the purpose of atomizing the fuel, and the like.

In the fuel injection device 10 constructed as described above, when the coil 23 is powered at a specified pulse width or greater so that a magnetic driving force is generated, the fuel pressure-feeding stroke is initiated, and in the initial region of this pressure-feeding stroke (until the plunger 21 moves to the position indicated by the two-dot chain line S), fuel containing vapor that is pressurized to a specified pressure passes through the check valve 25 and is discharged into the return pipe 5 from the plunger passage 21*a*.

When the plunger 21 moves from the initial region into the later region, the fuel inside the pressure-feeding chamber P is further pressurized. Then, the fuel that has been pressurized to a specified pressure or greater opens the check valve 27; this fuel is metered by passing through the orifice nozzle 31, and opens the poppet valve 32, so that this fuel is injected as a mist into the intake passage 2*a* from the injection port 33 together with assist air.

Meanwhile, when the powering of the coil 23 is cut off, the plunger 21 is returned to the waiting position by the driving force of the return spring. In this case, the check valve 24 opens so that fuel is drawn into the pressure-feeding chamber P from the feed pipe 3, and this fuel waits for the next injection.

Furthermore, when powering and non-powering of the coil 23 are repeated in accordance with a pulse width that is equal to or less than a specified value, the plunger 21 performs a reciprocating motion within the range of the initial region up to the point where the plunger passage 21*a* is closed off by the spill valve 26 (i.e., until the plunger 21 moves into the position indicated by the two-dot chain line S). Accordingly, the fuel containing vapor that is present inside the pressure-feeding chamber P is discharged into the return pipe 5 from the plunger passage 21*a* without being discharged into the injection nozzle 30 (i.e., without being injected into the intake passage 2*a*).

The engine control unit 40 used as control means comprises a control part 41 such as a CPU or the like which performs various types of calculations and sends out control signals, a driving driver 42 which drives the fuel injection pump 20, a detection circuit 43 which detects various state quantities and outputs the detection results to the control part 41, a detection circuit 44 which detects the state of the key switch 60 (whether the power supply is on or off), the voltage of the battery 50 and the like, and outputs the detection results to the control part 41, a memory part 45 in which various types of information including engine operating information are stored, and the like.

Here, the detection circuit 43 detects state quantities such as the current value or driving pulse frequency with which the coil 23 is powered by the driving driver 42, the degree of opening of the throttle valve 2*b*, the temperature of the engine 2 detected by a temperature sensor 2*c*, or the like.

Next, the driving of the fuel injection pump 20 in the abovementioned fuel supply system will be described with reference to the flow chart in FIG. 2 and the timing charts in FIGS. 3 and 4.

Figure 3:
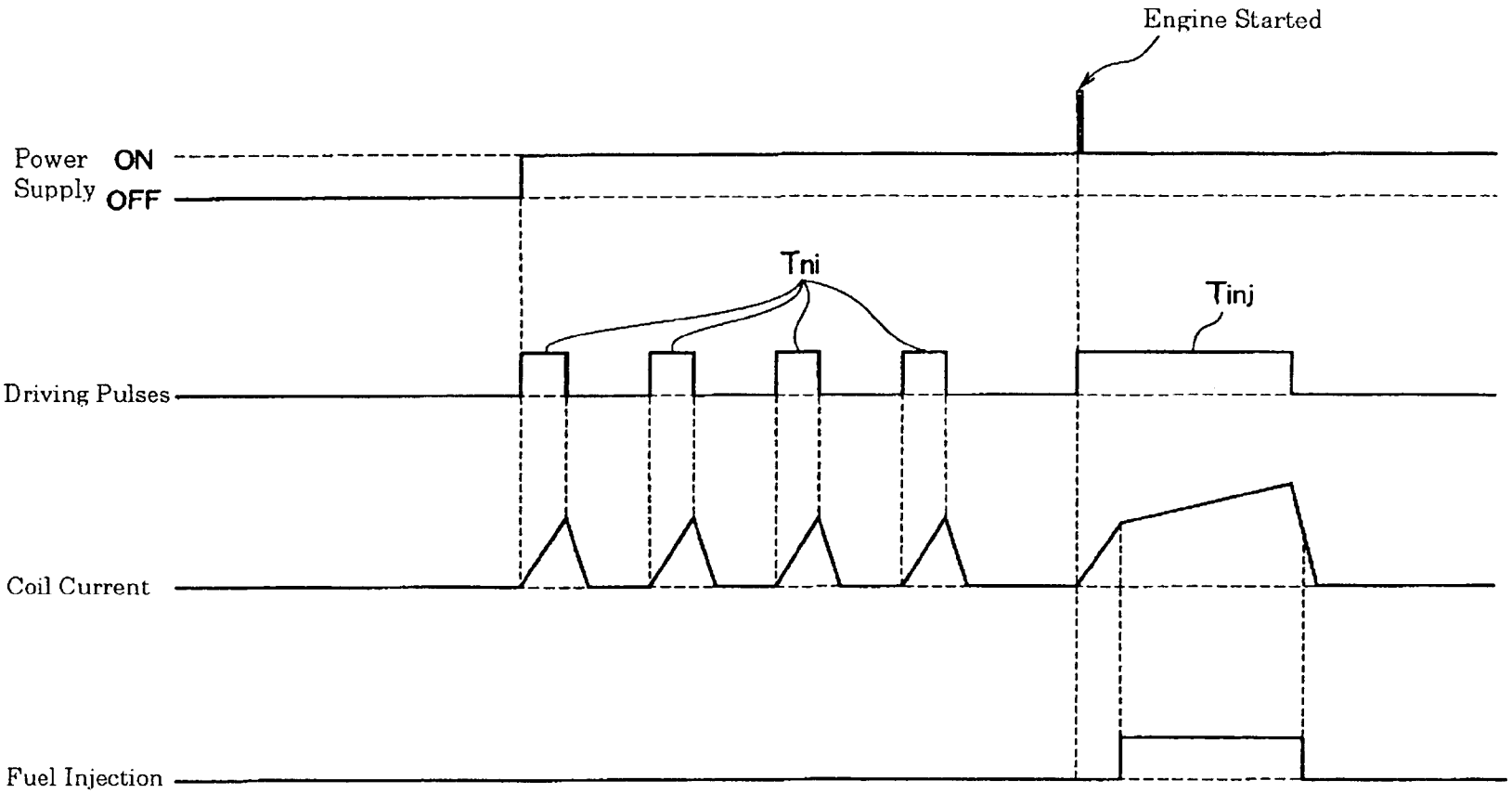

First, when the key switch 60 is switched on (i.e., when the power supply is placed in an "on" state) (step S1), the control part 41 sends a control signal to the driving driver 42, so that the driving driver 42 performs pulse powering of the coil 23 that does not lead to the injection of fuel, as is shown in FIG. 3 (step S2).

Specifically, the driving driver 42 performs pulse powering of the coil 23 in which non-injection driving pulses Tni that drive the plunger 21 within the range of the initial region of the pressure-feeding stroke (as long as no fuel is injected, this range may also include the range immediately after the point where the plunger passage 21*a* is closed) are sent out.

Furthermore, in this pulse powering, it would also be possible to arrange the system so that the control part 41 performs various calculations on the basis of the state quantities detected by the detection circuits 43 and 44, and sends control signals to the driving driver 42, and so that the driving driver 42 sets a pulse width that does not lead to fuel injection on the basis of these control signals, and performs pulse powering of the coil 23 accordingly.

Thus, since the plunger 21 is driven in the initial region of the pressure-feeding stroke before the engine 2 is started, the vapor that has accumulated inside is expelled in advance. Especially in cases where the engine 2 is stopped after high-load operation, and the engine is re-started after being allowed to sit "as is", there is a possibility that large quantities of vapor will accumulate. However, since the vapor that is generated is expelled beforehand, the engine 2 can be smoothly re-started.

Next, a judgement is made as to whether or not the key switch 60 has been turned to the start position so that the engine 2 has started (step S3). Here, in cases where the engine has not yet been started, the driving driver 42 performs pulse powering that sends non-injection driving pulses Tni to the coil 23.

This powering using non-injection driving pulses is preferably performed for a specified period of time after the key switch 60 has been switched to an "on" state, with a timer (not shown in the figures) or the like being provided to measure the time. Alternatively, a counter (not shown in the figures) is provided so that the number of pulses is counted, and powering is performed for a specified number of pulses. As a result, useless driving following the complete expulsion of the vapor can be avoided, so that the power consumption can be reduced.

Meanwhile, in cases where it is judged that the engine 2 has started in step S3, various state quantities are detected by the detection circuits 43 and 44 so that the operating state of the engine 2 is detected (step S4), and a judgement is made on the basis of this detected information as to whether or not the engine 2 is in an idle operating state (step S5).

Here, in cases where it is judged that the engine 2 is not in an idle operating state, the driving driver 42 performs pulse powering that sends injection driving pulses Tinj to the coil 23 so that fuel is injected in accordance with the operating state on the basis of a control map or the like that is stored in the memory part 45.

On the other hand, in cases where it is judged in step S5 that the engine 2 is in an idle operating state, the control part 41 performs various types of calculations on the basis of the state quantities detected by the detection circuits 43 and 44, e.g., at least one of the state quantities consisting of the immediately preceding coil current, the voltage of the power supply (battery 50), and immediately preceding frequency of the injection driving pules Tinj, and the like, and sends control signals to the driving driver 42. Then, on the basis of these control signals, the driving driver 42 performs pulse powering of the coil 23 that does not lead to the injection of fuel.

Figure 4:
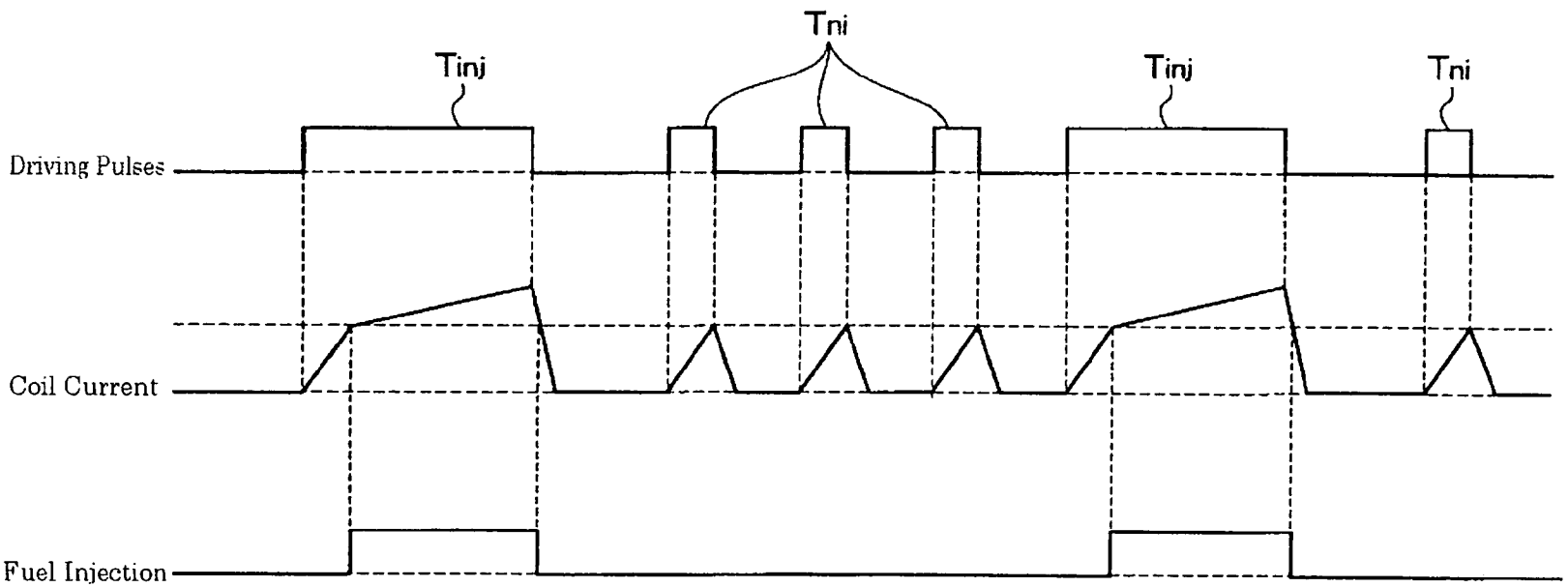
FIG. 4 is a timing chart which illustrates the pulse powering of the fuel injection pump when the engine is in an idle operating state.

Specifically, as is shown in FIG. 4, the driving driver 42 performs pulse powering in which non-injection driving pulses Tni that do not lead to injection are sent a plurality of times to the coil 23 in the intervals between one injection driving pulse Tinj that causes the injection of fuel and the next injection driving pulse Tinj. In the idle operating state, the width of the injection driving pulses Tinj is short, and the period is relatively long; accordingly, non-injection driving pulses Tni of the abovementioned type can easily be inserted (added).

As a result, even in the idle operating state in which the fuel flow rate is small, the vapor that is generated can be efficiently expelled; furthermore, the heat generated by the coil 23 can be cooled, so that the generation of vapor can also be suppressed.

Next, a judgement is made as to whether or not the key switch 60 has been turned in the opposite direction so that the engine 2 has been stopped (step S7). Here, in cases where it is judged that the engine 2 is still in an operating state and has not been stopped, the processing returns to step S4, and steps S4, S5 and S6 are repeated.

On the other hand, in cases where it is judged in step S7 that the engine 2 has been stopped, a judgement is next made as to whether or not the key switch 60 has been switched off (step S8). Here, in cases where it is judged that the key switch 60 is still in an "on" state (i.e., has not been switched off), the processing returns to step S2, and the driving driver 42 performs pulse powering (similar to that describe above) of the coil 23 that does not lead to the injection of fuel.

Specifically, the driving driver 42 performs pulse powering in which non-injection driving pulses Tni are sent to the coil 23 for a specified time after the engine 2 has been stopped, or for a specified number of times after the engine 2 has been stopped.

Especially in cases where the engine 2 has been stopped immediately after high-load operation, large quantities of vapor are generated, and this vapor accumulates inside the fuel passage. Accordingly, when an attempt is made to re-start the engine 2 in this state, vapor is admixed with the fuel and injected, so that the amount of injection becomes non-uniform, thus making it difficult to start the engine 2. Accordingly, as was described above, the plunger 21 is driven in the initial region prior to the re-starting of the engine 2, so that the vapor that has accumulated inside is securely expelled, thus causing homogeneous fuel from which vapor has been removed to be injected, so that the engine 2 can be smoothly re-started.

Figure 5:
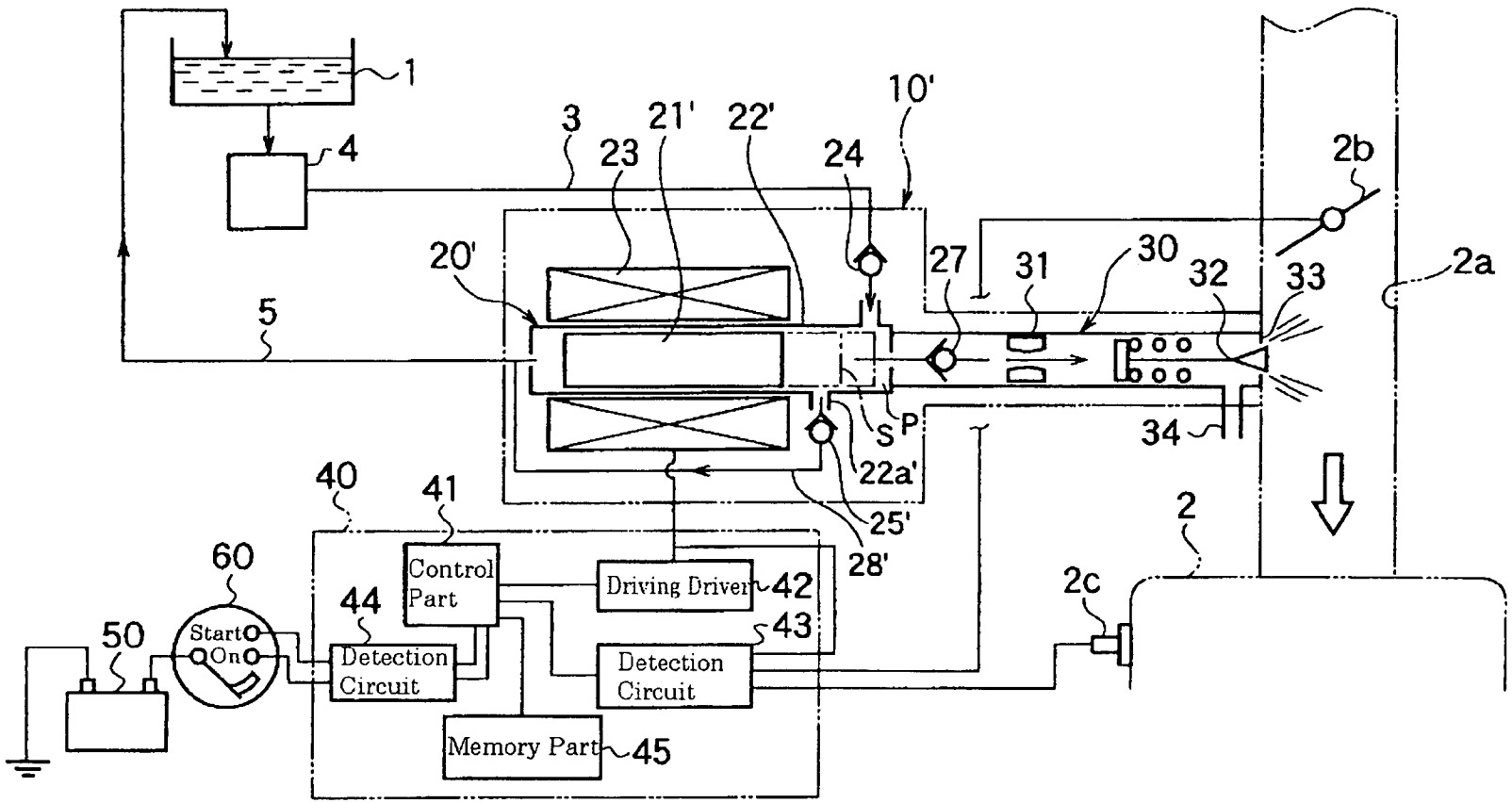
FIG. 5 is a schematic structural diagram which shows a fuel supply system employing another fuel injection pump using the driving method of the present invention.

FIG. 5 is a schematic structural diagram which shows another embodiment of the fuel supply system.

In this embodiment, parts other than the structure of the fuel injection pump are the same as in the above-mentioned embodiment; accordingly, the same constructions are labeled with the same symbols, and a description of these constructions is omitted.

As is shown in FIG. 5, the fuel injection pump 20' that forms a part of the fuel injection device 10' comprises a plunger 21' which performs a reciprocating motion, a cylinder 22' which accommodates the plunger 21' so that the plunger 21' is free to slide, an excitation coil 23' which is used to generate lines of magnetic force in a yoke (not shown in the figures) disposed on the outside of the cylinder 22', a check valve 24 which allows only flow into the pressure-feeding chamber P demarcated on the tip end of the cylinder 22', a check valve 25' which is disposed in a circulation hole 22*a*' formed in the side surface of the cylinder 22', and which allows flow only into the return pipe (return passage) 5 from the pressure-feeding chamber P via a circulation passage 28', a check valve 27 which allows discharge when the fuel inside the pressure-feeding chamber P is pressurized to a specified pressure or greater, and the like.

Furthermore, when the coil 23 is not powered, the plunger 21' is driven by a return spring (not shown in the figures) so that this plunger 21' is positioned in the waiting position (i.e., the position indicated by a solid line in FIG. 5). Here, furthermore, the system is arranged so that the outer circumferential surface of the plunger 21' closes the circulation hole 22*a*' at the end of the initial region of the pressure-feeding stroke (i.e., at the position indicated by the two-dot chain line S in FIG. 5); thus, this has a function similar to that of the abovementioned spill valve 26.

In the fuel injection device 10' constructed as described above, when the coil 23 is powered at a pulse width that is equal to or greater than a specified value so that an electromagnetic driving force is generated, the pressure-feeding stroke of the fuel is initiated, and in the initial region of this stroke (i.e., until the plunger 21' moves to the position indicated by the two-dot chain line S), fuel containing vapor that has been pressurized to a specified pressure passes through the opened check valve 25' from the circulation hole 22*a*', and is discharged into the return pipe 5 via the circulation passage 28'.

When the plunger 21' moves into the later region from the initial region, the fuel inside the pressure-feeding chamber P is pressurized even further. Then, fuel that has been pressurized to a specified pressure or greater opens the check valve 27; this fuel is metered by passing through the orifice nozzle 31, and opens the poppet valve 32, so that this fuel is injected as a mist into the intake passage 2*a* from the injection port 33 together with assist air.

Meanwhile, when the powering of the coil 23 is cut off, the plunger 21' is returned to the waiting position by the driving force of the return spring. In this case, the check valve 24 opens so that fuel is drawn into the pressure-feeding chamber P from the feed pipe 3, and this fuel waits for the next injection.

Furthermore, when powering and non-powering of the coil 23 are repeated in accordance with a pulse width that is equal to or less than a specified value, the plunger 21' performs a reciprocating motion within the range of the initial region up to the point where the circulation hole 22*a*' is closed off by the outer circumferential surface of the plunger 21' (i.e., until the plunger 21' moves into the position indicated by the two-dot chain line S). Accordingly, the fuel containing vapor that is present inside the pressure-feeding chamber P is merely discharged into the return pipe 5 via the circulation hole 22*a*' and circulation passage 28 without being discharged into the injection nozzle 30 (i.e., without being injected into the intake passage 2*a*).

Figure 2:
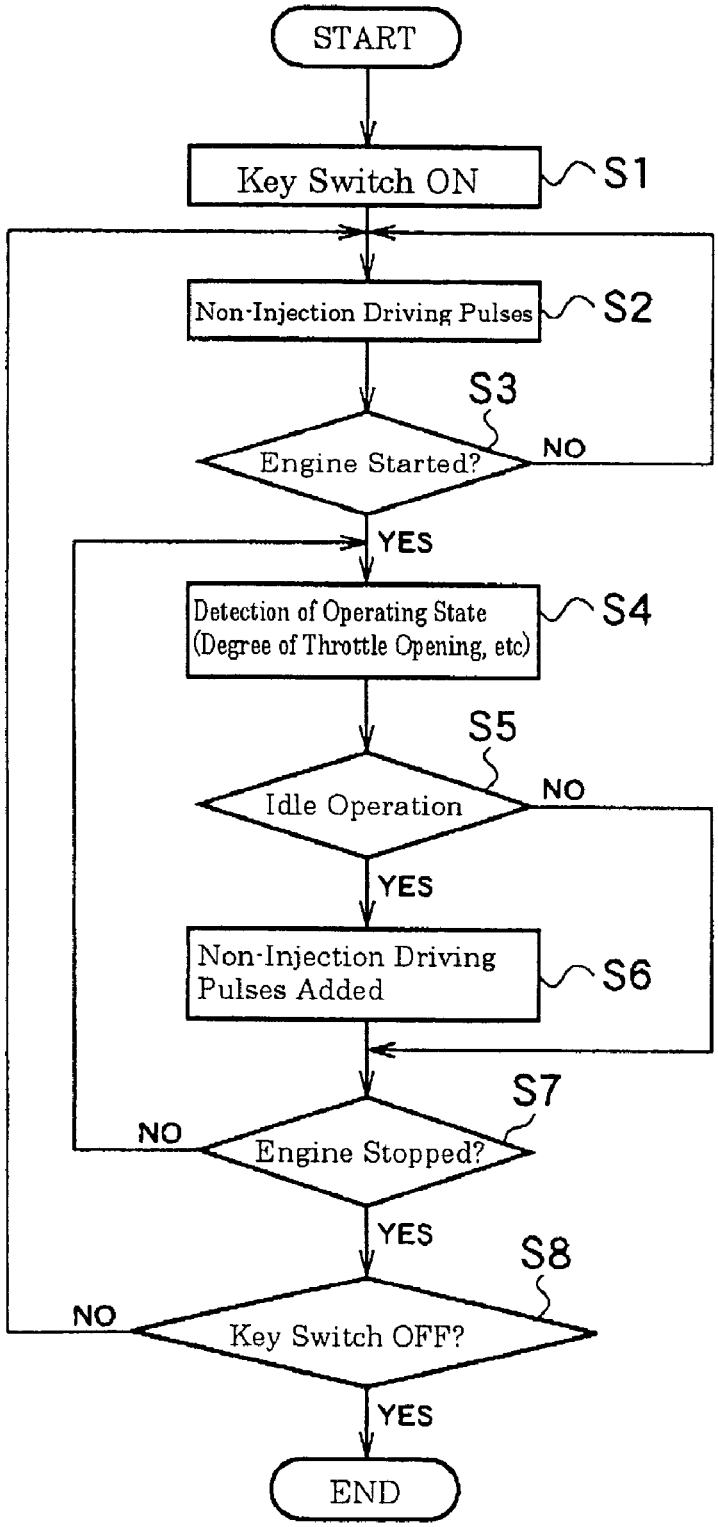
FIG. 2 is a flow chart which illustrates the fuel injection pump driving method of the present invention.

In the case of the abovementioned fuel injection pump 20' as well, as is shown in FIGS. 2 through 4, pulse powering that does not lead to the injection of fuel (i.e., pulse powering that sends out non-injection driving pulses Tni) is performed when the engine 2 is in an idle operating state, or when the key switch 60 has been switched on (i.e., when the power supply has been switched on), so that the efficiency of vapor expulsion can be increased, and so that stable fuel injection can be performed and the restarting characteristics and the like can be improved.

In the abovementioned embodiments, an apparatus in which the fuel injection pump 20 or 20' and the injection nozzle 30 were formed as an integral unit was described as the fuel injection device 10 or 10'; however, the driving method of the present invention can similarly be used in a system in which these two parts are installed separately and connected by means of fuel piping or the like.

Furthermore, in the abovementioned embodiments, an idle operating state or a state in which the key switch 60 was switched on and the engine 2 was stopped was indicated as a specified state of the engine 2. However, as along as non-injection driving pulses Tni can be added, the vapor expulsion efficiency can be improved, a cooling effect can be insured and the generation of vapor can be suppressed by performed similar pulse powering in low-load operating states or the like (other than the idle operating state) as well.

Furthermore, in the abovementioned embodiments, cases were described in which pulse powering that did not lead to the injection of fuel was performed for a preset period of time or number of times. However, instead of using such a set period of time or number of times, it would also be possible to make an appropriate determination of the time period or number of times for which pulse powering that does not lead to fuel injection is performed on the basis of the fuel temperature or temperature information such as the outside air temperature, engine temperature, oil temperature, coil temperature or the like, which is related to the fuel temperature. As a result, useless driving can be avoided so that the power consumption can be reduced, and higher-precision powering control can be performed in accordance with the operating state of the engine.

In the fuel injection pump driving method of the present invention, as was described above, vapor can be efficiently expelled, the flow rate of the circulated fuel can be increased, and the cooling effect can also be heightened, by performing pulse powering of the coil that does not lead to the injection of fuel when the engine is in a specified state, e.g., an operating state or high-temperature stopped state in which vapor tends to be generated in the fuel, such as the idle operating state or a state in which the engine is stopped and the power supply is "on", in a fuel injection pump comprising a discharge mechanism that can discharge fuel without injecting this fuel in the initial region of the pressure-feeding stroke of the plunger. As a result, the generation of vapor is also suppressed, the injection of the fuel is stabilized, and the re-starting characteristics in particular are improved.

What is claimed is:

1. A method for driving a fuel injection pump, which comprises:

a plunger which draws in and pressure-feeds fuel by means of a reciprocating motion, allowing the fuel to escape into the return passage in the initial region of the pressure-feeding stroke, and pressure-feeding the fuel into the injection port in the later region of the pressure-feeding stroke;

a magnetic excitation coil which exerts an electromagnetic exciting force on said plunger; and means for controlling the powering of said coil so as to cause injection of fuel in accordance with the operating conditions of the engine;

wherein said control means perform pulse powering of said coil that does not lead to the injection of fuel, when the engine is in a specified state.

2. The fuel injection pump driving method according to claim 1, wherein said control means perform pulse powering of said coil that does not lead to the injection of fuel during intervals between pulse powering that causes the injection of fuel when the engine is in an idle operating state.

3. The fuel injection pump driving method according to claim 1, wherein said control means perform pulse powering of said coil that does not lead to the injection of fuel when the power supply that is used to start the engine is placed in an "on" state prior to starting.

4. The fuel injection pump driving method according to claim 3, wherein said control means perform pulse powering of said coil that does not lead to the injection of fuel for a specified period of time after said power supply has been placed in an "on" state.

5. The fuel injection pump driving method according to claim 3, wherein said control means perform pulse powering of said coil that does not lead to the injection of fuel for a specified number of times after said power supply has been placed in an "on" state.

6. The fuel injection pump driving method according to claim 1, wherein said control means set a pulse width for said coil that does not lead to the injection of fuel, on the basis of at least one of the state quantities consisting of the current of said coil, the voltage of the power supply and the frequency of pulse powering that causes the injection of fuel.

7. The fuel injection pump driving method according to claim 1, wherein said control means set a pulse width for said coil that does not lead to the injection of fuel, on the basis of temperature information.

8. The fuel injection pump driving method according to claim 1, wherein said control means determine on the basis of temperature information whether or not to perform pulse powering that does not lead to the injection of fuel.

9. The fuel injection pump driving method according to claim 2, wherein said control means set a pulse width for said coil that does not lead to the injection of fuel, on the basis of at least one of the state quantities consisting of the current of said coil, the voltage of the power supply and the frequency of pulse powering that causes the injection of fuel.

10. The fuel injection pump driving method according to claim 3, wherein said control means set a pulse width for said coil that does not lead to the injection of fuel, on the basis of at least one of the state quantities consisting of the current of said coil, the voltage of the power supply and the frequency of pulse powering that causes the injection of fuel.

11. The fuel injection pump driving method according to claim 4, wherein said control means set a pulse width for said coil that does not lead to the injection of fuel, on the basis of at least one of the state quantities consisting of the current of said coil, the voltage of the power supply and the frequency of pulse powering that causes the injection of fuel.

12. The fuel injection pump driving method according to claim 5, wherein said control means set a pulse width for said coil that does not lead to the injection of fuel, on the basis of at least one of the state quantities consisting of the current of said coil, the voltage of the power supply and the frequency of pulse powering that causes the injection of fuel.

13. The fuel injection pump driving method according to claim 2, wherein said control means set a pulse width for said coil that does not lead to the injection of fuel, on the basis of temperature information.

14. The fuel injection pump driving method according to claim 3, wherein said control means set a pulse width for said coil that does not lead to the injection of fuel, on the basis of temperature information.

15. The fuel injection pump driving method according to claim 4, wherein said control means set a pulse width for said coil that does not lead to the injection of fuel, on the basis of temperature information.

16. The fuel injection pump driving method according to claim 5, wherein said control means set a pulse width for said coil that does not lead to the injection of fuel, on the basis of temperature information.

17. The fuel injection pump driving method according to claim 2, wherein said control means determine on the basis of temperature information whether or not to perform pulse powering that does not lead to the injection of fuel.

18. The fuel injection pump driving method according to claim 3, wherein said control means determine on the basis of temperature information whether or not to perform pulse powering that does not lead to the injection of fuel.

19. The fuel injection pump driving method according to claim 4, wherein said control means determine on the basis of temperature information whether or not to perform pulse powering that does not lead to the injection of fuel.

20. The fuel injection pump driving method according to claim 5, wherein said control means determine on the basis of temperature information whether or not to perform pulse powering that does not lead to the injection of fuel.

* * * * *